US010022605B2

(12) United States Patent
Ozkaya

(10) Patent No.: US 10,022,605 B2
(45) Date of Patent: Jul. 17, 2018

(54) TRAINING DEVICE FOR IMPROVING REACTION CAPABILITIES, REFLEXES, SPEED AND FURTHER ASSOCIATED, SPORTS-RELATED, PHYSICAL AND COGNITIVE SKILLS OF A USER IN TRAINING

(71) Applicant: Besil Ozkaya, Worms (DE)

(72) Inventor: Besil Ozkaya, Worms (DE)

( * ) Notice: Subject to any disclaimer, the term of this patent is extended or adjusted under 35 U.S.C. 154(b) by 167 days.

(21) Appl. No.: 14/901,084

(22) PCT Filed: Jun. 27, 2014

(86) PCT No.: PCT/DE2014/100217

§ 371 (c)(1),
(2) Date: Dec. 28, 2015

(87) PCT Pub. No.: WO2014/206400

PCT Pub. Date: Dec. 31, 2014

(65) Prior Publication Data

US 2016/0129326 A1 May 12, 2016

(30) Foreign Application Priority Data

Jun. 28, 2013 (DE) ..... 10 2013 010 849

(51) Int. Cl.

| | |
|---|---|
| ***A63B 69/34*** | (2006.01) |
| ***A63B 67/10*** | (2006.01) |
| ***A63B 69/00*** | (2006.01) |
| ***A63B 69/20*** | (2006.01) |
| ***A63B 69/24*** | (2006.01) |

(Continued)

(52) U.S. Cl.

CPC ..... *A63B 67/10* (2013.01); *A63B 21/4043* (2015.10); *A63B 69/004* (2013.01); *A63B 69/20* (2013.01); *A63B 69/24* (2013.01); *A63B 21/1681* (2013.01); *A63B 69/0053* (2013.01); *A63B 2022/0092* (2013.01); *A63B 2071/026* (2013.01); *A63B 2210/50* (2013.01); *A63B 2225/093* (2013.01)

(58) Field of Classification Search

CPC ..... A63B 21/1681; A63B 2022/0092; A63B 67/10; A63B 69/0053; A63B 69/0079; A63B 69/0084; A63B 69/20; A63B 69/203; A63B 69/205; A63B 69/206; A63B 69/24; A63B 2071/026; A63B 2225/093; A63B 69/004; A63B 69/0073; A63D 7/00

See application file for complete search history.

(56) References Cited

U.S. PATENT DOCUMENTS 474,760 A * 5/1892 Peterson ..... A63B 69/004 482/89
716,163 A * 12/1902 Yoerger ..... A63B 69/205 482/87

(Continued)

*Primary Examiner* — Joshua Lee
(74) *Attorney, Agent, or Firm* — Mark M. Friedman

(57) ABSTRACT

A training device, including: at least two respective response target (7); at least two elastic holder cords (6), each holding said at least one respective response target, wherein each said elastic holder cord (6) is located, in a taut state, between at least one attachment point above a training area and a floor attachment, wherein said at least two holder cords (6) are placed at a distance from one another, with response targets (7) placed thereon, and are connected by a momentum coupling.

21 Claims, 12 Drawing Sheets

(51) Int. Cl.

| | |
|---|---|
| ***A63B 21/00*** | (2006.01) |
| *A63B 21/16* | (2006.01) |
| *A63B 71/02* | (2006.01) |
| *A63B 22/00* | (2006.01) |

(56) References Cited

U.S. PATENT DOCUMENTS

| | | | | |
|---|---|---|---|---|
| 2,045,972 | A * | 6/1936 | Tompkins | A63B 69/206 482/89 |
| 4,088,316 | A * | 5/1978 | Szafianski | A63B 43/007 273/DIG. 26 |
| 4,345,755 | A * | 8/1982 | Eidson | A63B 69/201 482/86 |
| 4,749,185 | A * | 6/1988 | Spears | A63B 69/206 482/89 |
| 6,461,281 | B2 * | 10/2002 | Bouvier | A63B 69/201 482/83 |
| 6,716,143 | B1 * | 4/2004 | Martin | A63B 22/001 482/62 |
| 8,012,047 | B2 * | 9/2011 | Gamboa | A63B 69/00 473/438 |
| 8,257,088 | B1 * | 9/2012 | Askins | G09B 19/003 434/247 |
| 9,050,518 | B2 * | 6/2015 | Hall | A63B 69/20 |
| 2004/0110607 | A1 * | 6/2004 | Crespo | A63B 69/206 482/89 |
| 2010/0087296 | A1 * | 4/2010 | Hansen | A63B 69/0053 482/83 |
| 2010/0179031 | A1 * | 7/2010 | Luigi | A63B 69/004 482/89 |
| 2010/0248908 | A1 * | 9/2010 | Ramsay-Matthews | A63B 69/004 482/89 |
| 2012/0252637 | A1 * | 10/2012 | Pellot | A63B 69/20 482/89 |
| 2013/0065735 | A1 * | 3/2013 | Conarty | A63B 69/20 482/89 |

* cited by examiner

TRAINING DEVICE FOR IMPROVING REACTION CAPABILITIES, REFLEXES, SPEED AND FURTHER ASSOCIATED, SPORTS-RELATED, PHYSICAL AND COGNITIVE SKILLS OF A USER IN TRAINING

FIELD OF THE INVENTION

The present invention refers to a chaotic training device for exercising and developing such skills as reaction capability, reflexes, speed, punch combinations, precision of hand-eye and foot-eye coordination, peripheral vision (use of the peripheral visual field), extension of visual sensitivity, sense of balance, coordination capacity, fine motor skills, accuracy, condition, strength, maneuverability, concentration, vigilance, spontaneity, exercising complex motion sequences etc., which, after application of some force, produces continuous and constantly changing, irregular, rapid, unpredictable and chaotic movement of training elements, which can be responded to by the user in different ways.

BACKGROUND OF THE INVENTION

The training of the reaction capabilities, reflexes, coordination, speed, and peripheral vision is of great importance for many sports disciplines and everyday life, e.g. road traffic. For this purpose, a training device is necessary, which produces rapid movements of the elements to be hit in a manner unpredictable by the user. Therefore, the movements to be responded to by the user must be chaotic, irregular and constantly changing. There is no prior art relating to a training device meeting said requirements, and more particularly, capable of producing continuous irregular and chaotic movements of response targets.

SUMMARY OF THE INVENTION

After an external force is applied, the present invention generates movements of response targets (e.g. balls), which are unpredictable for the user and facilitate a complex workout without a training partner for development of capabilities mentioned heretofore and hereafter.

To generate unpredictable, rapid and chaotic movement of the training elements (also referred to herein as "response targets"), in one of the embodiments of the present invention, the response targets are attached to thin, elastic cords or rubber cables at hitting or response height, and at least one other object (counterweight) for creation of an opposite force or countermovement, e.g. another ball, is attached to the same rubber cord below or above (or both below and above) the response target. On the floor, the elastic cord of this individual element is attached, for example, to a weight.

The position of the floor weight can be adjusted individually in accordance with the training requirements. Similarly, the length, and thus the tension of the cords can be adjusted, for example, by means of coils around a rod placed on the weight. At the upper end, the individual cord is attached to a support element, e.g. in the form of a triangle, to which several of the individual elements are attached, so as to trigger a countermotion deflecting additionally the response targets towards the counterweight. The support element can be suspended e.g. from the ceiling by means of a suspension element and is capable of moving freely in all directions. All individual elements and the support element are interconnected and under tension. After a force is applied to a response target, the support element rotates occasionally around its own axis up to a certain degree generating additional movement and energy in the system by abrupt and rapid counter-rotation. The individual elements can be removed from the complete unit to be used for separate training or more elements can be added according to the training requirements.

Every application of force to a response target has an immediate effect on all other response targets and on the support element, i.e. on the entire system, which is thus put in motion. Even small forces are sufficient for this purpose. The user strikes the response target or hits it otherwise, thus putting into motion the counterweight(s) on the same cord. This countermotion of the ball or weight situated below or above the response target affects the motion of the response target and deflects it permanently. Without countermotion (s), caused either by one or more counterweights on the individual cords or by other individual elements placed on the support element each generating a separate countermotion, an individual response target attached to an elastic cord would merely swing back and forth, i.e. it would carry out a predictable and calculable movement. The manner of interaction of the response targets, counterweights and individual elements makes their motion irregular, unpredictable, chaotic and multidirectional. The motion is non-linear and alternates constantly and spontaneously between swinging, rotating, looping, jumping, zigzagging in all spatial directions. Every additional hit or strike of the ball triggers a series of entirely different movements. Thus, the chaotic movement is achieved by the presence of at least one countermotion to the response target and by the related interaction. The deflecting elements causing countermotions are the counterweight(s) on the individual cords, and other individual elements with their own irregular motion, whereby the irregular motion of each response target of the system is mutually enhanced or gains additional aspects. Thus, relevant individual objects of the invention are interconnected in a momentum-linked manner.

Every strike against one of the response targets or each movement of the system sets all the counterweights and reaction targets of the other individual elements into irregular motion. All individual elements are constructively interconnected and sensitive to each other and each application of force affects the entire system. Thus, all irregular motions affect each other and the entire system. The entire system thereby moves in a chaotic, irregular manner. This triggers a dynamic continuous sequence of totally uncommon, unique situations. The user, by skillful reaction and by different strikes and dodges, must attempt hitting or dodging different response targets, either standing in front of the construction or inside the construction for 360-degree training after the floor weights are changed. Users can also train around the construction. The scope of application extends to several sports, where development of the aforementioned skills is important. The invention can also be used as an everyday or leisure training device, as it presents no risk of injury. Unlike other devices, there is hardly any resistance during training. The invention can be used for visual training for medical purposes, e.g. in order to regulate dysfunctions of the eyes or to improve eye performance.

Athletes of different disciplines or people in everyday situations require the aforementioned skills to achieve better competition results or to cope with dangerous situations. For development of said skills, a training device is necessary that generates the motion of several elements, which require response. Complexity of the motion excludes the possibility of prediction thereof. Thus, the elements must generate differentiated, abrupt, unpredictable and chaotic movements in all spatial directions to be responded to within fractions of seconds in the form of e.g. strikes, kicks or dodges. The movement of these elements must include alternating movements such as hopping, loop, circle, zigzag movement, etc. After the user has set these elements to motion by application of force e.g. by a stroke, this chaotic, irregular behavior of the training elements must be maintained for a certain period of time even without constant application of an external force. Generation of the chaotic behavior of the training elements must thus be an inherent property of the system i.e. the training device itself, caused by application of an external force, and must not be definable by the user. In this manner, the user can previously identify neither the motion whereto he/she will have to react nor the place where the object will be the next moment. He/she can neither predict the complexity of the movements generated by the training device nor the movements themselves. Therefore, he/she is unprepared and must respond each time to a different situation, with highest concentration, spontaneously and as rapidly as possible. The present invention meets all the aforementioned requirements, thus presenting a decisive advantage versus previous training devices.

Unlike in the present invention, previous training devices are unable to generate irregular and chaotic motion of the elements, whereto response is required. By comparison, the motion of previous training devices is calculable, linear and predictable. Therefore, the previous training devices do not represent an imminent system capable, after application of an external force, of generating chaotic motion of training elements i.e. response targets in an independent and continuous manner. Therefore, none of the previous training devices may be used for the effective development of the aforementioned skills. They are suited for improvement of speed and force, but in a static manner, inadequate to the complexity of real situations. If, for example, a boxer hits a speedball or a double end ball, the ball reacts in the same way as it was hit i.e. it carries out a regular back and forth or side-to-side movement. Thus, in the previous training devices, the user determines the motion of the training elements and must maintain it permanently by application of force.

Moreover, exercising various kinds of strikes or strike combinations is impossible in the previous training devices being limited to specific strikes only, whereas the present invention enables continuous performing any strikes at any time in the course of the training, which cannot be performed with the conventional equipment but can be required, for example, in a real situation in boxing.

Moreover, unlike in the present invention, training fine motor skills and complex movement sequences in conventional devices is impossible. With the speedball, for example, speed and force of the arms can be trained. However, the motion sequence is automated and does not represent an actual response to an object whose behavior in the next moment is unknown. The user is not required to exercise his/her creativity with regard to the strike combinations and, due to the movement and bulkiness of the object to be hit, he/she can carry out specific movements only.

Moreover, with previous training devices, the users are constantly limited to a single striking or response target, whose motion stops after a short time, for which reason fluid dynamic training is impossible. They neither use their peripheral vision, nor can train their response and reflex skills with several unpredictable objects or situations. Unlike with the present invention, all these disadvantages finally affect the motivation of the users, who do not have the opportunity to step up or to vary their training with the conventional training devices.

Accordingly, in view of the motion of their training elements, all conventional training devices are deterministic, linear, open systems, which have to be constantly set to motion from the outside, wherein the trigger of motion i.e. the applied force, corresponds deterministically to the effect, i.e. motion of the training elements, so that there is no irregular motion.

The present invention is intended to eliminate the technological deficiency described above and thus to close a serious gap in the state of the art of training devices for different sports involving aforementioned skills, as well as for everyday and medical use.

Apart from the aforementioned disadvantages, the problem related to the state of the art is that the previous training devices are unable to generate complex, unpredictable, chaotic movements to which the users must give a complex response for the development of said skills. Moreover, conventional training devices offer no possibility of performing all the strikes and creating a complex, reality-oriented situation, to which the user can respond.

The primary object of the present invention is to enable an unpredictable, irregular, chaotic, rapid, lasting movement of the training elements, i.e. response targets for training of the aforementioned skills, i.e. a situation complex in terms of the movements of the components and requirements for user related thereto, so that the skills mentioned hereinbefore and hereinafter can be developed optimally. This problem is solved by the attributes of the invention, as mentioned hereinbefore and discussed hereinafter in detail.

By the present invention, an effective, authentic, 3D training of the aforementioned skills, oriented towards the reality of an opponent (e.g. boxers and martial artists), is made possible for the first time without a training partner due to the complexity and unpredictability, chaotic and lasting behavior of the target or response objects, on the one hand, and by presence of several individual elements, which occupy the space in a manner similar to an opponent, on the other hand.

In the present invention, the user strikes or kicks (or applies force otherwise) the response target (e.g. balls), thus triggering a complex, chaotic and entirely unpredictable motion of several training elements, to which he/she must respond in the form of strikes, dodges, etc. The individual elements are interconnected by at least one support element or e.g. connecting cable. They form an integral whole, while every response target (and every counterweight) of an individual element reacts, at the same moment, differently.

In case of an embodiment of the present invention comprising e.g. three individual elements, this means that after one ball is hit, all other balls of the construction are immediately set into irregular motion. Just like a human opponent makes no uniform movement, while his/her arms, legs and head perform different movements, whereto response is required, the entire system of the present invention is set to motion, but unlike in the other training devices, each of its parts moves in a different manner. If the elements of the configuration with e.g. three individual elements are in motion and the user hits the rear reaction target, he/she must be simultaneously concentrated on several objects, in order to hit, on the one hand, and to dodge the response targets or other elements, on the other hand. This simultaneous focus on several objects that, in addition, do not move linearly and change their position entering space, offers maximum training possibilities of said skills, while several capabilities are required and used at the same time.

Due to the attributes of the invention, the individual response targets and counterweights, which can also be used as reaction targets, for example by foot kicks, react in an entirely different way and the movement lasts for a longer time even without constant application of force by the user. Thus, fluid and dynamic training is enabled, wherein the ever new, unpredictable and differentiated ball movement permanently requires spontaneous reactions or movements and maximum concentration on the part of the user. The training can be changed discretionarily or perplexed e.g. by changing position of the floor weights or adding further individual elements, so that a constant increase of performance is enabled unlike with conventional training devices.

Within fractions of seconds, the users must locate the rapidly moving response targets and decide which one and how to hit or whether the moving training elements are to be dodged. He/she reacts, among other things, following his/her reflexes i.e. spontaneously and instinctively, which leads to increased performance in this area; at the same time, however, he/she acts purposefully, proceeding strategically and deciding which ball to hit and which maneuver would be appropriate for hitting it, without being hit by other response targets in motion. This simultaneous activation of the reflex capacity, of the deliberate decision (strategy) and other skills in face of a completely unknown situation is an important element in the training with the present invention, because only in this manner reflexes, reaction capabilities and other qualities can be improved.

Apart from the aforementioned attributes, the present invention offers a training device, which makes possible all kinds of strikes and combinations, as performed e.g. in boxing and kicks in other sports in a consecutive manner.

However, as previously mentioned, the everyday life also requires trained reflexes, accuracy of movement, high reaction speed and suchlike, as there are numerous situations in everyday life, where these skills are essential. By training on the present device, the response time, for example, is dramatically shortened, which makes reaction in road traffic significantly faster.

After every hit (or other application of force), every ball (response target and counterweight) of every individual element is set to a constantly and independently changing and unpredictable motion. Namely, after the first blow already, the response target hit (and consequently the entire system) does not simply swing back and forth, but moves in an alternating and autonomous manner, carries out e.g. a loop motion, then jumps to the side or up and down in the next moment, rotates in all directions or makes zigzag movements, etc. Thus, the user can be truly designated as a responder, which is not the case with conventional devices, because the user must determine and maintain the movement him-/herself there, and the training is more or less limited to the same. With the present invention, the user is able to develop the aforementioned skills in an optimal manner.

The present invention comprises a training device in the form of a partially closed system that, after application of external force, is independently capable of generating, for a relatively long time, irregular, chaotic and thus unforeseeable or unpredictable movements of training elements to be responded to by the user. Hence, this invention is the sole training device to meet the requirements of generating truly irregular and chaotic movement. By the presence of several training elements set to irregular motion (individual elements with response targets and counterweights), with variable position and occupying the space in a 3D manner, a situation is created in which the user must, like in a sparring situation, resort to different capabilities simultaneously.

The invention is designed so as to ensure high sensitivity to changes in the initial conditions, whereby the chaotic behavior of the training element is enhanced even more. This means that after each strike or application of force (initial situation), the entire system reacts in a different manner and every change, no matter how small (e.g. tension and angle of the suspension cord, intensity of strikes, etc.), leads to different changes (type and sequence of the movements, duration, speed, etc.). Therefore, unlike with the conventional devices, the user cannot become accustomed to a specific situation, but must react spontaneously and rapidly every time, whereby different skills of the user are addressed simultaneously. This permits permanent development of the aforementioned skills.

In order to pursue complex training for the development of the aforementioned skills, the present invention, in most of the embodiments described hereinafter, possesses at least three individual elements. The latter are provided with response targets in the form of small balls and counterweights, which also consist of small balls, whose size, weight and nature correspond to the reaction targets. In a number of embodiments, the response targets and the counterweights differ from each other in terms of size, material and weight. For example, individual elements are attached, by means of a freely movable support element suspended from the ceiling. The individual elements can be easily removed from the support element and used separately for "irregular" training, because, if they are furnished with one or more counterweights, they can generate irregular and chaotic motion, which is, however, no match to the entire system consisting of several individual elements in terms of the complexity. In the entire system consisting of several individual elements, chaotic and unpredictable effect features additional dimensions and aspects. For example, the radius of the movement of the response targets is greater due to rotation of the support element, and change of different modes of movement occurs more frequently and abruptly. Moreover, due to the movement of the support element in all directions including up and down, a corresponding movement of the response target occurs. At the same time, the complete unit enables further training targets, such as usage of the peripheral vision, coordination of legs and upper body, 3D maneuverability, i.e. moving in a manner similar to the real bout or sparring situation (as e.g. in boxing), as the users are confronted with a multitude of moving response targets and can exercise attack and defense simultaneously, whether with their own body or with a training object (as e.g. in fencing, Kendo, etc.).

The irregular and chaotic, hence unpredictable movement of the reaction targets (and the counterweights) in the individual element is generated, in principle, by an additional weight or weights attached below (or above or both below and above) in addition to the response target(s), which, by application of forces to the response target, starts moving by itself due to the connecting elastic cord, and whose motive force acts on the upper ball, influencing or deflecting its movement, thus creating permanent reciprocal countermovement. In trials with prototypes the counterweight positioned at a distance of 30-40 cm between floor and counterweight, i.e. a great distance between response target and counterweight, and between response target and support element, yielded good results. However, this is not obligatory, as the irregular effect results from other configurations too, for example when the counterweight is attached above the response target or when the distance to the floor is greater or smaller. Nevertheless, the distance should not be too small, because this would cause absolutely no effect or inappropriate effect. According to the desired effect, the user can change the position of the response target(s) and counterweight(s).

In principle, permanent interaction of the objects, i.e. movement of the response target and counterweight, generates irregular and chaotic motion thereof. Thin elastic cords made of 65% elastodiene and 35% polyester, with a thickness of 1.5 mm, have yielded good results in prototypes of the present invention. However, other materials and dimensions can be used too, as long as the sensitivity of the system with regard to the initial conditions is not impaired.

The reaction target and the counterweight influence one another permanently even without application of external force creating continuous movement thereof. If the height of the lower ball or weight is changed in relation to the upper ball, this affects the movement (e.g. movement radius) of the upper ball. Similarly, a change in the angle of the elastic cord in relation to the plummet by changing position of the floor weight affects the movement. In order to achieve the highest possible irregularity, the device must be adjusted so that there is high sensitivity with regard to the initial conditions, i.e. to the application of force by the user. Apart from the design, this can be achieved by the use of thin, elastic cords and balls (or other objects) of an adequate size, weight and quality, which react sensitively and strongly to application of an external force e.g. by a blow.

Moreover, the initial conditions also depend on the tension of the cord, which is adjustable just as other factors. When hit, the ball rotates occasionally around its own axis, which in addition to the other motive forces generated, causes further chaos and unpredictability within the system.

After the force is applied to a reaction target and its own movement thus generated, the support element, which, due to the suspension with elastic cords, is freely movable in all the direction, i.e. also up and down, transmits force to the individual elements and influences their movement. Once the individual elements are set to motion, their movement is already irregular, which, in turn, affects constantly the movement of the support elements and all other individual elements, which is also irregular. Thus, on the one hand, all the individual elements including the support element, show irregular movements, thus influencing each other. Said movement is increased once a force is applied to the system in any manner whatsoever. Additional e.g. upwards and downwards movements of the balls are thus enabled.

Several embodiments of the present invention described hereinafter, comprise no counterweight or counterweights on the individual element. In this case, the other individual elements act solely as counterweights and generate the countermotion necessary for the irregular motion.

Both the tension of the rubber cords and the distances between the balls and between the balls and the support element, affect the type of the movement and can be easily adjusted for each element individually, by the weight on the floor and by the height of the balls. For example, the radius of the irregular movement is smaller if the distance between the balls of an individual element is decreased. Similarly, the angle between the rubber cords and the plummet can be adjusted by positioning the floor weights, which also affects the movement of the balls. The prototype trials have shown that good results are obtained when the elastic cords of the individual elements are slightly (but not too) taut and angled i.e. not ideally vertical. Cords that are too taut have a negative effect. In addition to the positive effect of inclination of the individual elements in relation to the movement of the response targets, tangling of the individual elements prevents the cords from slackening, if e.g. lower velocity of the response targets is to be achieved. Thus, the users have the possibility of very easy and entirely flexible adjustment of the training device to their training requirements, which is a further advantage as compared to the conventional training devices.

The support element must be made of a light material e.g. aluminum and can have a triangular form. Other forms and materials are possible too, if appropriate. Preferably elastic cords, e.g. of the same quality as the cords of the individual elements lead from the corners, respectively corners and sides of the triangle, to the center of the triangle, where they meet, and are attached to a spring hook or suchlike, which is attached to a ceiling hook, so that the suspended construction including the support element can move freely in all directions. If the ceiling is too high, an additional rubber cord or suchlike, with the desired length, can be attached to the ceiling, the support element being attached to the lower end of this cord by a spring hook or suchlike.

In some embodiments, at the corners, respectively corners and sides of the triangle, there are suspension points to which the individual elements are attached e.g. by small spring hooks. Similarly, on the intermediate elements comprised in some embodiments, suspended from the support element, several points of suspension may be present, so that, in such a case, several individual elements can also be suspended e.g. using small spring hooks. If a cord of the individual element breaks, it can be replaced in this manner without any problem. This is a further advantage as compared to the embodiment, wherein the individual elements are connected in a fixed manner being neither removable nor replaceable.

The material, shape and size of the support element can differ unless it impairs sensitivity of the system. The advantage of light material e.g. aluminum or a thin wire consists in proper propagation of the force and every movement of the individual elements. It should feature sufficient strength but may also be flexible to a certain extent so that it can swing slightly, when the force is applied. The triangular form is an advantage inasmuch as the position of the individual elements simulates the position of a human opponent. Similarly, size, shape and material of the response targets and counterweights can vary to a certain extent and depend, among other things, on the degree of difficulty of the training and advancement of the user. The response targets and counterweights can be made e.g. from the following materials: rubber (e.g. ball with a diameter of 4 cm), foam (e.g. ball with a diameter of 7 cm), leather etc. Other materials and sizes can be used in accordance with the training objective and degree of difficulty, whereby the system sensitivity should always be maintained. For example, a leather ball with a diameter of 30 em suspended on an elastic cord with the thickness of 1.5 mm would not be purposeful. The same applies to cord thickness. There are limits here too. No irregular effect is generated above certain dimensions and weights. As described hereinafter thin elastic cords and correspondingly small response targets are preferred, as they yield the best results. Material, form and weight of the response targets and counterweights need not be identical. However, the weight difference must not be essential otherwise the mutual application of force would be impaired or no longer lie within an appreciable range. The weight of the response targets and counterweights must correspond to the system sensitivity. In most prototypes, small hollow rubber balls (diameter 4 cm, weight approx. 25 g; comparable with squash balls) of the same size and material were used as response targets, yielding very good results. Apart from the positive effect regarding irregularity, training of the aforementioned skills with small objects is preferable as they are more difficult to hit. In the embodiments described hereinafter, wherein e.g. one response target and one counterweight are positioned below and one—above the response target, in terms of weight distribution, the response target can move towards the lower counterweight, and the upper counterweight can replace the reaction target. In this case, there are two counterweights below the response target. Similarly, other embodiments are conceivable so as to influence for example the movement speed and radius in the maneuvering area. Thickness and material of the elastic cords must match the size or weight of the response targets and counterweights, so that sensitivity and the irregularity effect are not impaired.

In most of the embodiments described hereinafter, the elastic cord (or rubber cord etc.) is run through small holes in the balls, so that the height is easily adjustable by the users at a later date. This has such additional effect that the ball occasionally rotates around its own axis and increases the rotation energy in addition to the irregularity effect. Although the balls are held by friction, they can be attached easily by a knot above and below the ball or by means of rubber clamps, knotted bands, cord stoppers, etc.

Moreover, it is possible for several persons to train simultaneously on the invention. Due to easy disassembly of the device into individual elements and option of adding further individual elements, the training can be varied, perplexed and complemented. Instead of training on the total unit with three individual elements, one individual element can be removed easily and suspended from the ceiling separately, for training on this element alone. Thus, training is also possible away from home or when travelling. Similarly, further elements are added to the total construction, so that the training is perplexed.

The invention can be used not only as a training device, but also as an instrument for the demonstration of chaotic processes in physics or mathematics.

Different embodiments of the invention are possible. Some of these embodiments are explained hereinafter in several drawings. Both mentioned and unmentioned but possible combinations and versions of embodiments are based on the aforementioned principle of the invention. High sensitivity to the initial conditions, namely, to the force applied, is guaranteed by the choice of the materials, size and weight of the elements. In combination with counterforces or countermotions to the response target and at least one support element with adequate suspension design, as well as mobility and adjustability of the system staying under permanent tension this leads to the desired results. In case of the individual element, the countermotion(s) is/are ensured by the counterweight(s) on the same cord, whereas in the whole unit—by the counterweights of one of the individual elements and movements of other individual elements, i.e. by the response targets and counterweights thereof, or, in some examples, without counterweights on the individual cords, but only by the reaction targets of other individual elements. In case of demountable embodiments equipped with counterweight(s), the individual element can be used separately for irregular training, because of also being capable of generating chaotic movements of the response targets, even though the movement is less complex than in the complete unit. In case of the complete unit configurations without counterweights on the individual elements, where only the reaction targets on the individual elements generate counterforces and countermotions, the individual elements can be disassembled in the same manner and used for separate training. However, in such a case no irregular effect is generated, as there is no counterweight and therefore no countermotion.

Individual adjustability of the embodiments by change of the position of the floor weights, tension of the elastic cords, height of the response targets, possibility of adding or removing individual elements, etc., serves, inter alia, for adjustment of the training to the individual requirements of the user in terms of size, degree of advancement, etc., as these changes also result in change of degree and type of irregularity. Thus, the user has the possibility to use the present invention as appropriate and vary it constantly to vary and intensify the training.

BRIEF DESCRIPTION OF THE DRAWINGS

The embodiments listed and described herein are examples; other embodiments, combinations and materials are possible if the principle aspects of the invention are retained. Various embodiments are herein described, by way of example only, with reference to the accompanying drawings, wherein.

DESCRIPTION OF THE PREFERRED EMBODIMENTS

Figure 1:
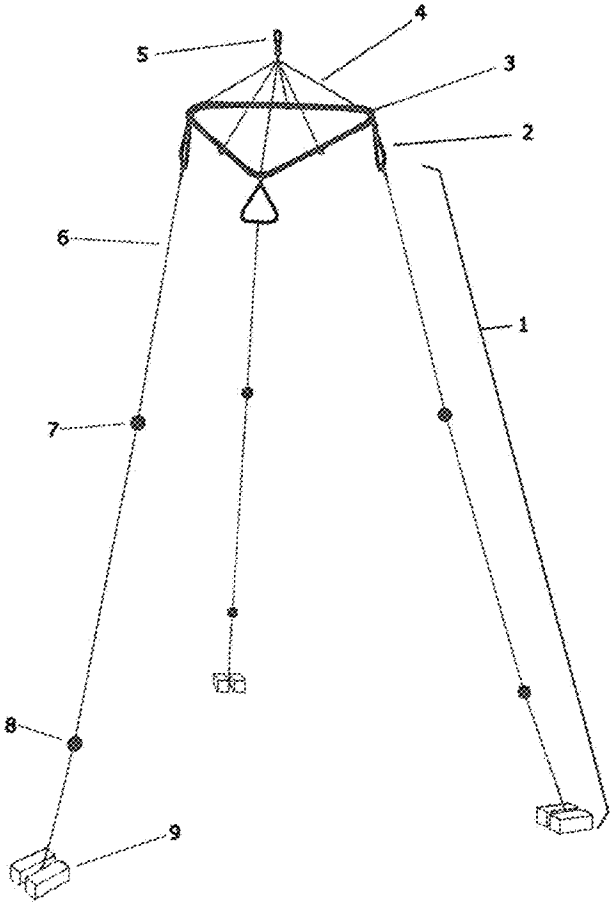
FIG. 1 shows an embodiment of the invention with three individual elements attached to a support element by means of intermediate elements.

FIG. 1 shows an embodiment of the invention with three individual elements (1) attached to a support element (3) by means of intermediate elements (2). The support element is attached to a suspension element (4) which is attached by a hook (5) (e.g. spring hook) to a corresponding suspension device e.g. on the ceiling. Thus, the invention can move freely in all directions and react with outmost sensitivity to the application of external force.

The individual element in this embodiment is constructed as follows: on the floor, there is a freely movable weight (e.g. 0.5 kg, preferably coated with rubber or suchlike), comprising a rod in its center around which the elastic cord (6) of the individual element is wound and finally fixed in position with a small hook (14) firmly connected to one end of the cord. It is thus guaranteed that the tension of the cord can be adjusted by further winding around the rod. Alternatively, the cord is firmly connected with the rod, which can be turned by means of a crank (16) positioned on the side of the weight, whereby length or tension of the cord can be adjusted.

The counterweight (8), which generates the countermotion to the response target (7), is placed in this embodiment at 30-40 cm distance from the floor weight or height above the floor, whereas the response target is placed above the counterweight and within blow height of the user, e.g. at an eye level. In prototype trials of the invention, good results were obtained when a cord with the length of 150 to 200 cm reaches in taut state a length between 200 and 250 cm. These, however, are merely values for exemplification. The tension can be adjusted in accordance with the training requirements.

In the present example, the distance between the response target and the suspension on the support element is approx. 80 to 100 cm. The distance of the reaction target from the suspension on the support element can vary, but should not be too small. The lateral length of the support element is approx. 55 cm. In the prototypes, the elastic cord comprised 65% elastodiene and 35% of polyester featuring thickness of 1.5 mm. Other compositions and materials are possible, as long as the high elasticity and thus the sensitivity to application of external force is guaranteed. In this embodiment, balls with a diameter of approx. 4 cm, with a weight of approx. 25 g made of rubber and hollow inside (similar to squash balls) were used as response target and counter weight, which yielded good results.

Alternatives in terms of material and size are possible, as long as they do not hinder the irregular movement and match the elastic cord and other elements in terms of weight etc. In this embodiment, the rubber balls are provided on the upper and lower part with a small hole, through which the cord is run. As the cord is pushed through the rubber material of the ball upon manufacturing, the ball does not slip downwards and can nevertheless be moved easily up and down by the user. Alternatively, below or both above and below the ball, cord stoppers (10) can be used, which, while preventing the possible slipping of the ball, nonetheless guarantee the adjustability of its height by pressing on the cord stopper, whereby the cord is released again. Alternatively, rubber band or suchlike can be knotted below and above the balls and can also be untied for adjustment.

An embodiment is also conceivable where the cord does not pass through the ball but the balls are equipped with small hooks on top and bottom, whereto the cords are attached. This embodiment would, however, have the disadvantage that the height of the response targets and the counterweights can no longer be adjusted easily. Cord (6) is provided at its upper end with a small spring hook, preferably of synthetic material or with rubber coating or suchlike. In the present embodiment variant, the cord is attached by means of the hook on a specific point at the intermediate element (2). The intermediate element serves, inter alia, for attaching several individual elements to the support element, as described in the embodiments hereinafter, in order to intensify or perplex training. For this purpose, the intermediate element is foreseen with several points whereto the individual elements can be attached or removed using e.g. a small spring hook. The intermediate element with the individual element(s) is also suspended using a small spring hook from the suspension points (11) on the support element (3) and can be removed together with the individual element for training using one or several individual elements without support element, for example, when traveling. In the present embodiment, the support element has the form of a triangle and is provided with six suspension points for individual elements, three of which are placed in the corners.

Other forms of support elements are possible, some of which are presented hereinafter. The support element, as well as the intermediate elements, should be made from a light material to guarantee sensitivity to force propagation and thus irregularity of movement of the balls. It can be coated with a material such as rubber. In prototypes of the present embodiments, the support element had the form of a triangle with side lengths of 50 to 55 cm. However, other dimensions are possible.

In the present embodiment, the support element is connected with a suspension element (4) (either fixed or mobile), comprising elastic cords of the same type and the cords of the individual elements brought together in the center from the corners and centers of the sides of the support element in a slightly taut state, where they are attached to the ceiling by means of a suspension spring hook. This type of suspension guarantees that the support element is mobile and, in particular, reacts sensitively to force propagation by the individual elements, which is important for the momentum propagation and the irregular effect of the response targets. Other suspension designs are conceivable as long as they do not affect negatively the movement of the response targets. Several alternative variants of the suspension element presented in FIG. 1 are presented in the following figures.

The elastic cords (6) of the individual elements are especially long and can be adjusted as described above, so that the invention can also be suspended from high ceilings. The tension of the cords can be adjusted easily on the floor weight, in accordance with the desired effect. This has the great advantage that, apart from the other adjustment options, scope and type of the irregular movement, as well as speed of the response targets can be influenced to a certain extent by adjustability of the height of response targets and counterweights.

Due to its design, the invention is under permanent tension and reacts sensitively to the smallest application of force, which results in a particularly intense irregular, chaotic motion. In the present examples, the position of the floor weights is such that the position of the elements is not perpendicular, but rather inclined, which, in the prototypes, had a positive effect on the chaotic, irregular movement.

An alternative configuration comprises no intermediate elements (2), while individual elements are suspended directly from the support element (3).

Figure 2:
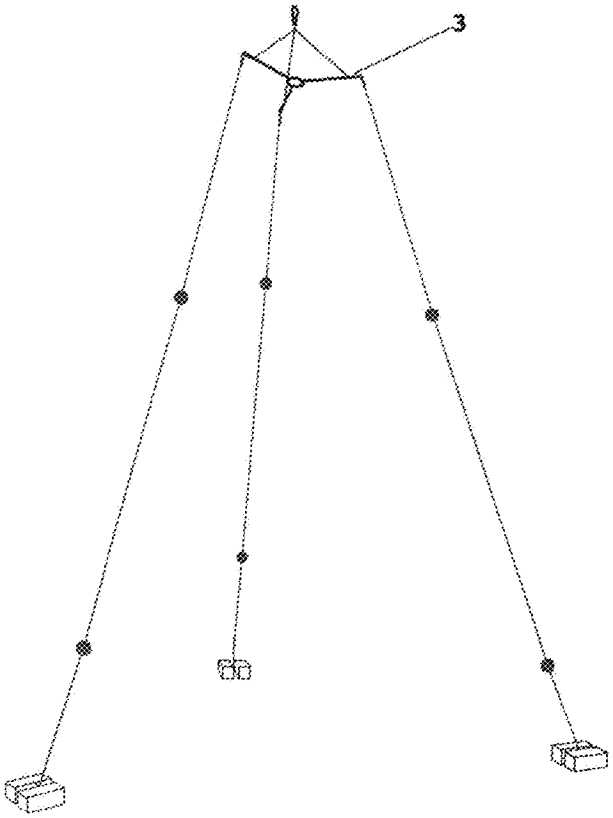
FIG. 2 shows an embodiment comprising the support element equipped with several arms that can be designed as rigid or flexible.

FIG. 2 shows an embodiment comprising the support element of a different form. The support element is equipped with several arms that can be designed as rigid or flexible, which has an additional effect on the momentum propagation and thereby on the mobility of the response targets and counterweights.

Figure 3:
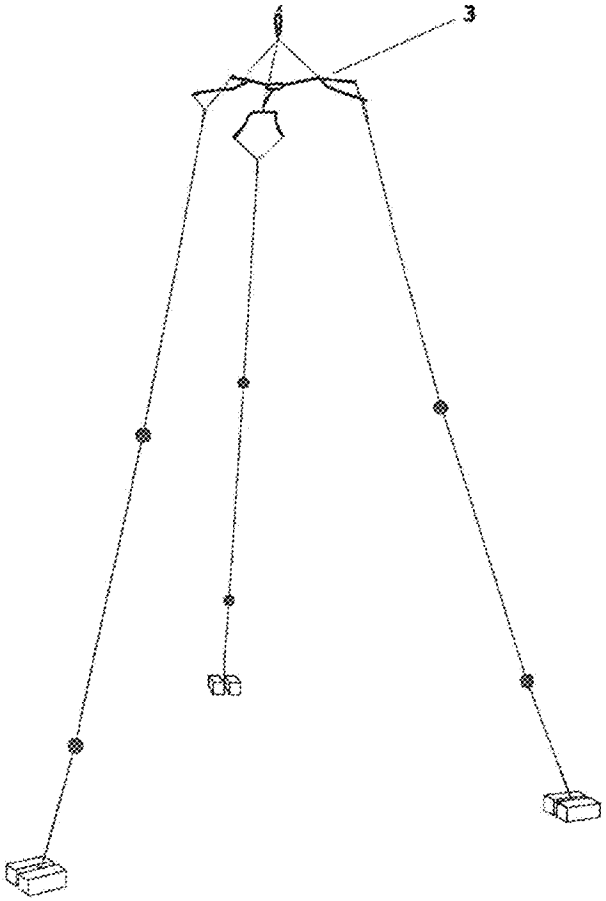
FIG. 3 shows another embodiment variant, where the individual elements are attached to elastic cords stretched crosswise on the support element comprising fork-shaped extensions.

FIG. 3 shows another embodiment variant, where the individual elements are attached to elastic cords stretched crosswise on the support element comprising fork-shaped extensions.

Figure 4:
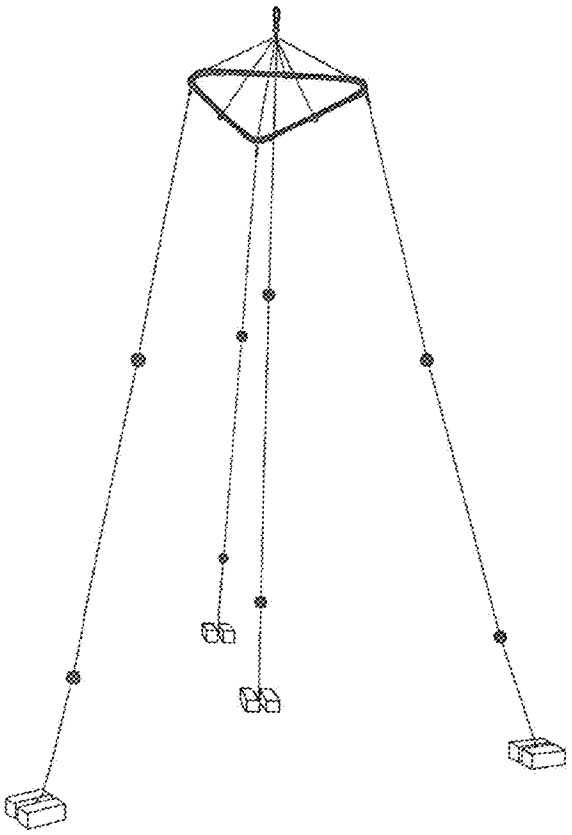
FIG. 4 shows an embodiment comprising a fourth individual element in its center.

FIG. 4 shows an embodiment comprising a fourth individual element in its center.

Figure 5:
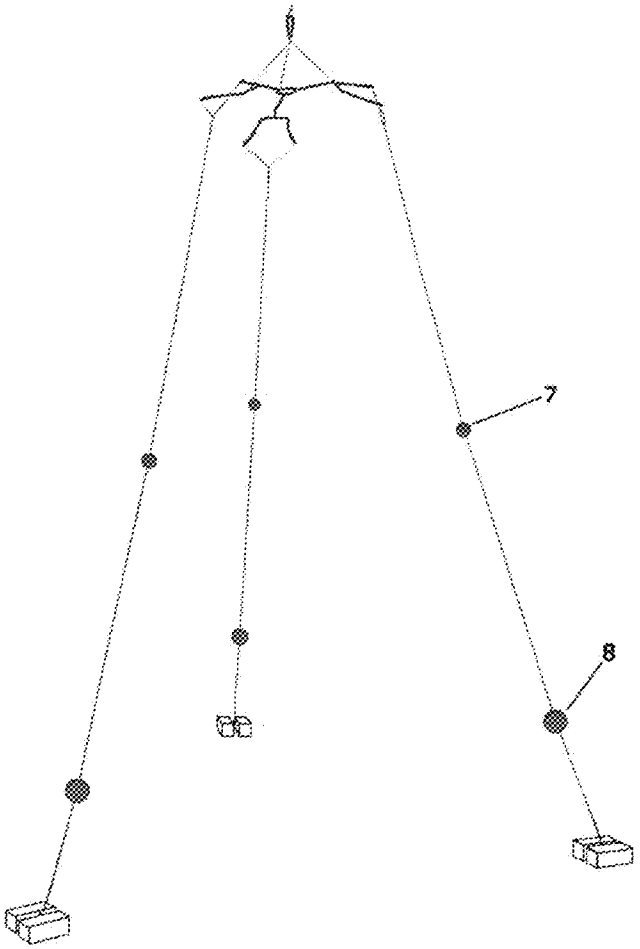
FIG. 5 shows an embodiment comprising response targets and counterweights of differential sizes and weight, whereby the momentum propagation is influenced.

FIG. 5 shows an embodiment comprising response targets (7) and counterweights (8) of differential sizes and weight, whereby the momentum propagation is influenced.

Figure 6:
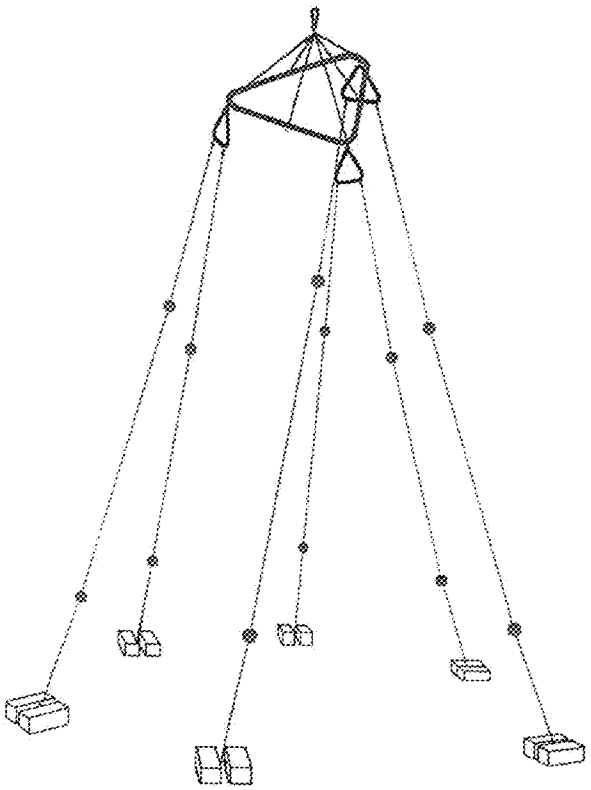
FIG. 6 shows embodiments comprising two individual elements attached to each of the intermediate elements.

FIG. 6 shows embodiments comprising 2 individual elements (1) attached to each of the intermediate elements (2).

Figure 7:
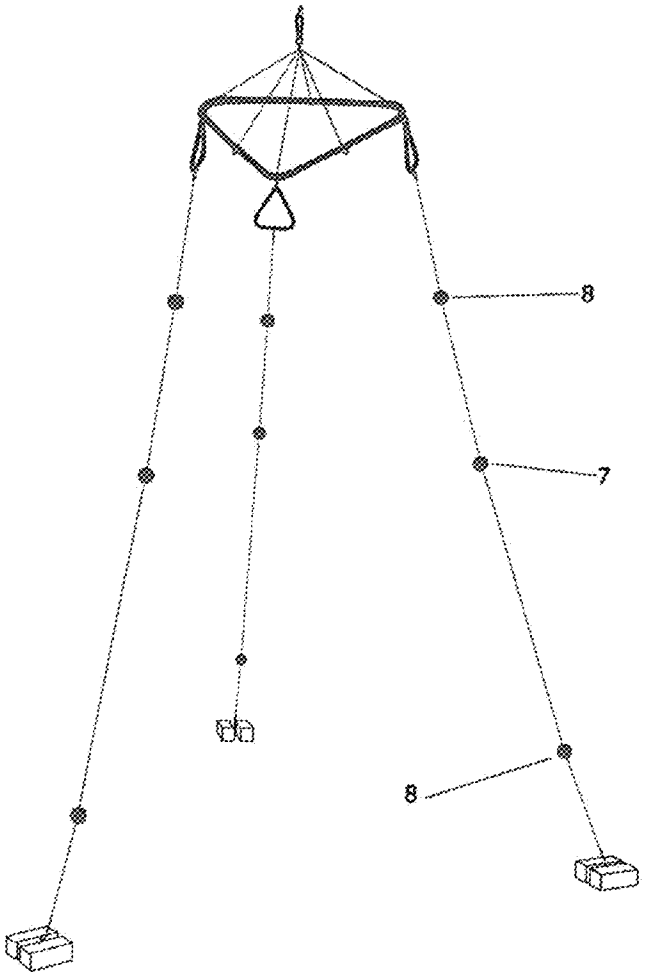
FIG. 7 shows embodiments comprising an additional counterweight above the response target, which can also be used as a second reaction target.

FIG. 7 shows embodiments comprising an additional counterweight (8) above the response target (7), which can also be used as a second reaction target. Further combinations of this type can be installed on the individual elements of this and other embodiments.

Figure 8:
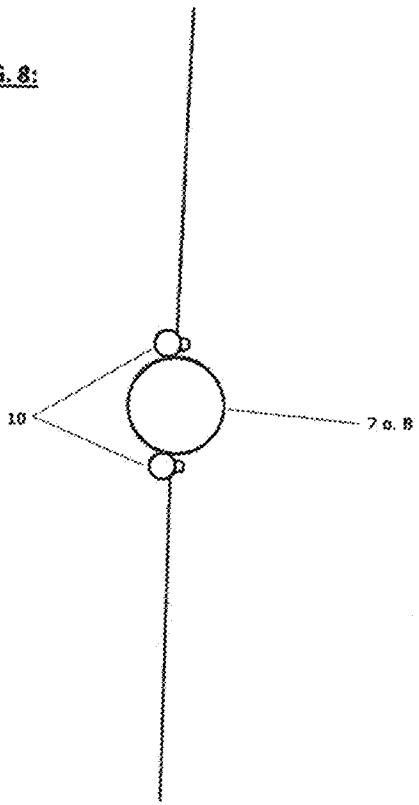
FIG. 8 shows a close-up side view of the response target or counterweight with cord stoppers.

FIG. 8 shows a close-up side view of the response target or counterweight (7 or 8) with cord stoppers (10).

Figure 9:
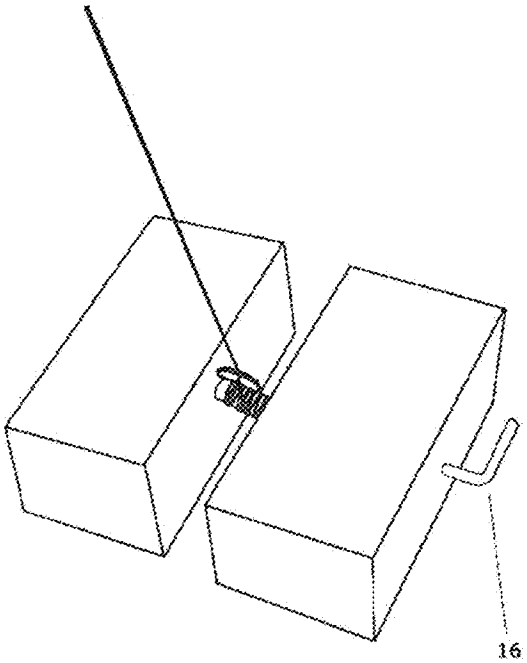
FIG. 9 shows an embodiment of the floor weight with crank, whereby the length of the cord can be adjusted, as an alternative to manual unwinding.

FIG. 9 shows a view of a floor weight (9), where the elastic cord (6) is wound around the rod 15 and is held in position by the hook (14). This is an embodiment of the floor weight with crank (16), whereby the length of the cord can be adjusted, as an alternative to manual unwinding.

Figure 10:
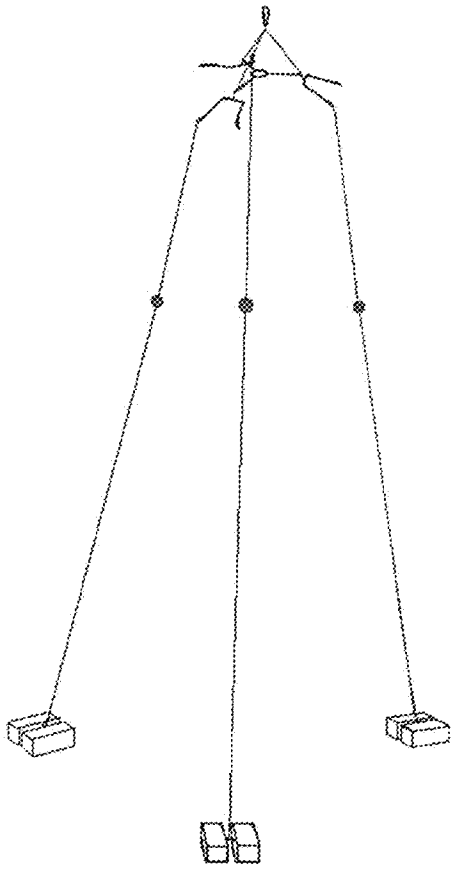
FIG. 10 shows an embodiment comprising no counterweights on individual elements, wherein only individual elements, i.e. the reaction targets act as counterweights and generate the required countermotion.

FIG. 10 shows an embodiment comprising no counterweights on individual elements, where only individual elements, i.e. the reaction targets act as counterweights and generate the required countermotion.

Figure 11:
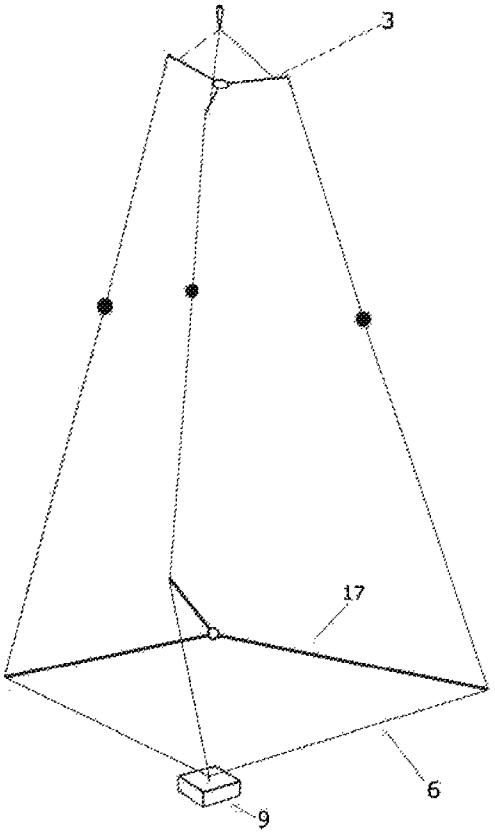
FIG. 11 shows a variant provided with a lower support element attached to the floor weight by means of several holder cords.

FIG. 11 shows a variant, where a lower support element (17) is attached to the floor weight by means of several holder cords (6). This creates a difference in the movement of the lower support element and in the momentum propagation with the upper support element (3).

Figure 12:
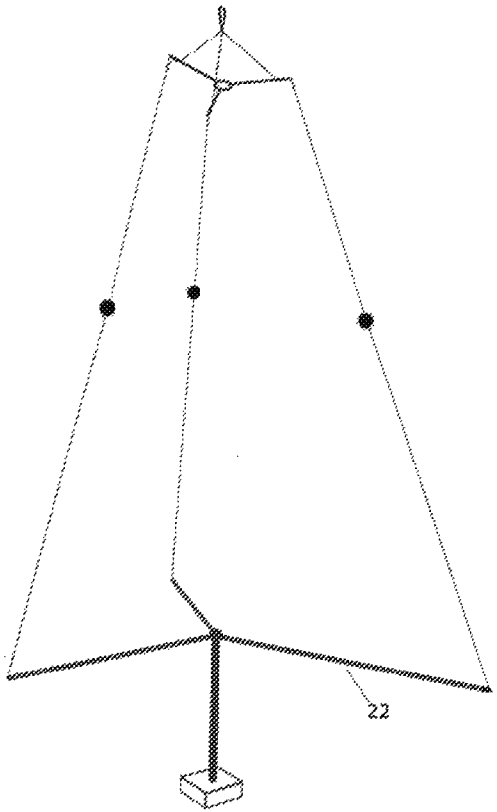
FIG. 12 shows a variant provided with a lower support element comprising flexible arms.

FIG. 12 shows a variant, where a lower support element (22) comprises flexible arms having a special effect on the irregular behavior of the response targets or response targets and counterweights. Alternatively, it comprises a fixed or flexible pedestal, which ensures an alternative type of momentum propagation in the lower support element. In this variant, the momentum propagation takes place in the lower and upper support elements, whereby both degree and type of irregularity are modified. It is, however, necessary to point out that flexible elements can be arrayed in great variability on both lower and upper support element.

Figure 13:
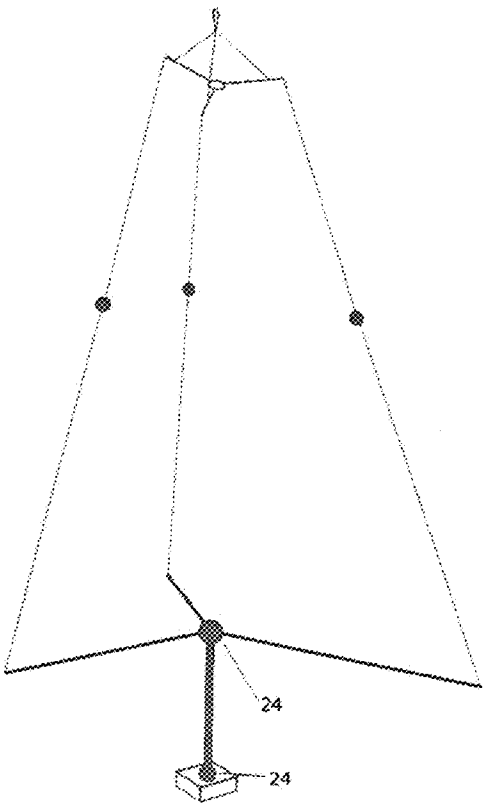
FIG. 13 shows a variant provided with a pedestal connected to the floor weight by means of a spherical element.

FIG. 13 shows a variant, where a pedestal (18) is connected with the floor weight by means of a spherical element (24), and is thus mobile. Similarly, the lower support element (17) is connected with the pedestal by means of a spherical element and is mobile. This increases the mobility of the lower support element, which leads to an increase in sensitivity to momentum propagation. A variant is envisaged, wherein each individual arm of the lower support element is made mobile by means of a spherical element (24). No momentum propagation takes place in the lower support element, however, the movement of the individual arms of the lower support element affects the movement of the holder cords and response targets.

Figure 14:
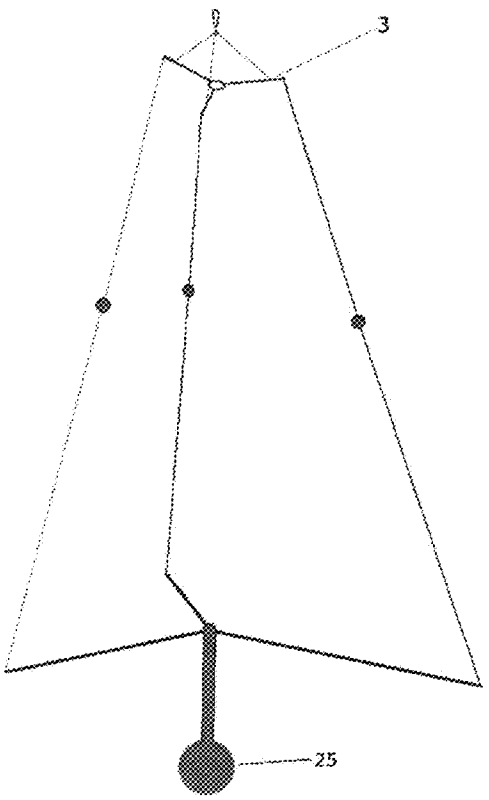
FIG. 14 shows a variant, where the pedestal has a spherical lower end and is firmly connected with the lower support element.

FIG. 14 shows a variant, where the pedestal has a spherical lower end and is firmly connected to the lower support element, whereby application of force to the response target makes the lower support element and pedestal move, causing momentum propagation.

Figure 15:
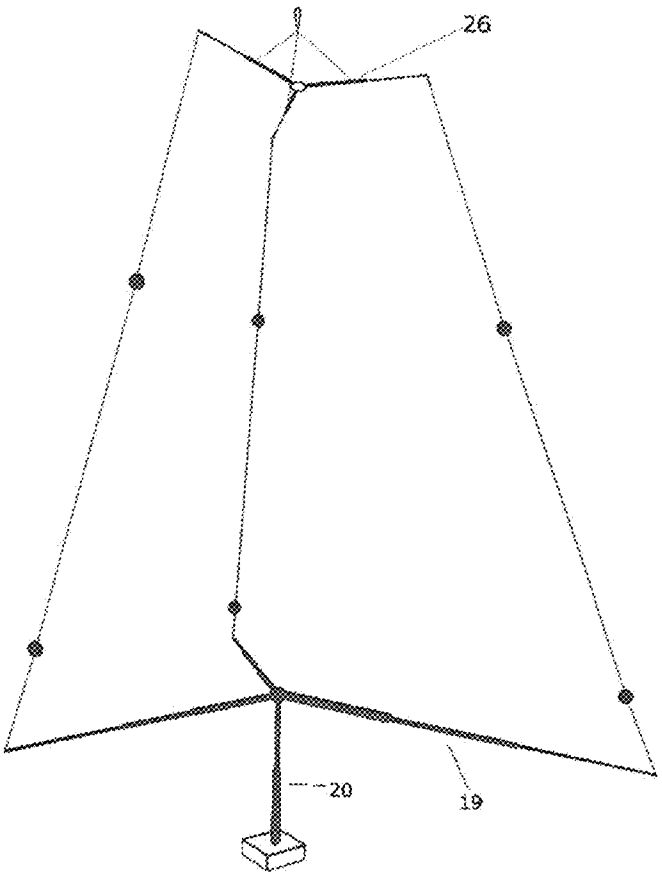
FIG. 15 shows a variant, where both upper and lower support elements are equipped with telescope arms.

FIG. 15 shows a variant, where both upper and lower support elements are equipped with telescope arms, whereby the angle and distance between the holder cords can be modified, for example, when several persons intend to use the training device. In addition, the tension of the holder cords can be modified by the telescopic design of the pedestal (20).

This telescopic structure can be attached to a multitude of constructive elements to both upper and lower carrier and fixing elements.

Figure 16:
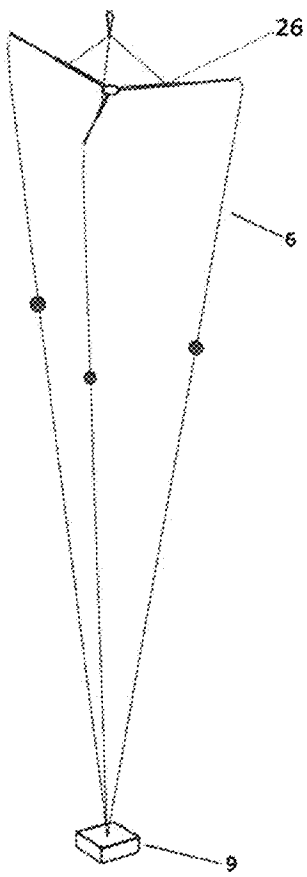
FIG. 16 shows a variant, where the holder cords of the individual elements are brought together in the lower part and attached to the floor weight.

FIG. 16 shows a variant, where the holder cords (6) of the individual elements are brought together in the lower part and attached to the floor weight (9). The distances between the holder cords and thus between the response targets are adjustable in this variant due to the telescopic design of the upper support element (26). This enables the user to select between training with smaller and larger field of vision. Another variant envisages for example the use of the upper support element without telescopic carrier arms.

Figure 17:
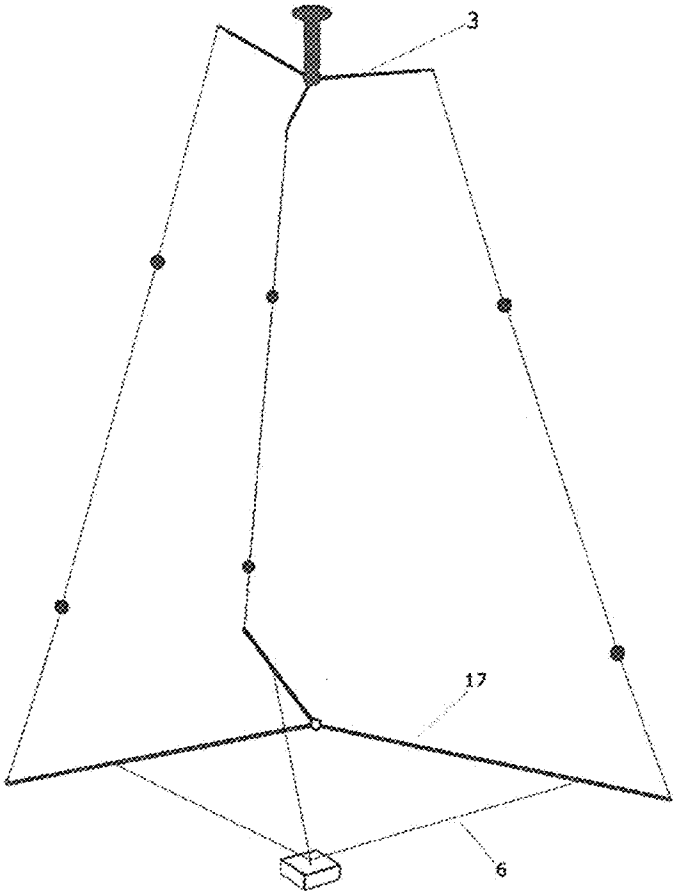
FIG. 17 shows a variant with a lower support element, where the momentum propagation takes place in the upper support element and in the lower support element.

FIG. 17 shows a variant with a lower support element (17), where the momentum propagation takes place in the upper support element (3) and in the lower support element (17). The optimum connection of the lower support element to the floor weight is by means of the elastic holder cords (6), however, as in this and other examples, use of non-elastic holder cords is possible, whereby the mobility of the lower support element is limited. When using non-elastic holder cords, the movement of the support element after application of force is more confined to horizontal plane, thus being rather a movement around the own axis. The same applies to the variant where the upper support element is attached to the ceiling by the holder cords and hooks. In this case both elastic and non-elastic holder cords can be used for suspension of the support elements.

The upper support element (3) is attached in this case to a fixed, flexible or elastic vertical suspension, whereas the arms in this embodiment are positioned on a spherical joint.

Figure 18:
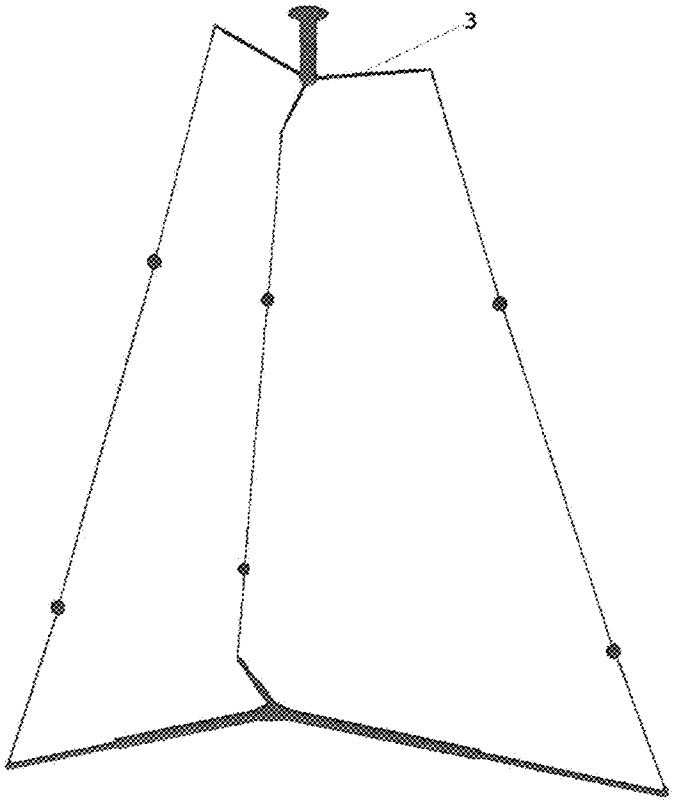
FIG. 18 shows a fixed support element and fixed floor element with telescopic arms.

FIG. 18 shows a fixed support element and fixed floor element (29) with telescopic arms. In this variant, no momentum propagation to the response targets occurs. The training is focused in this case on development of skills such as extension of the field of vision, speed, etc. Position of the floor element on the floor can be modified in this and other examples. In general, various types of mobility of the support element result in somewhat different momentum propagation, and thereby different movement of the response targets or response targets and counterweights.

Figure 19:
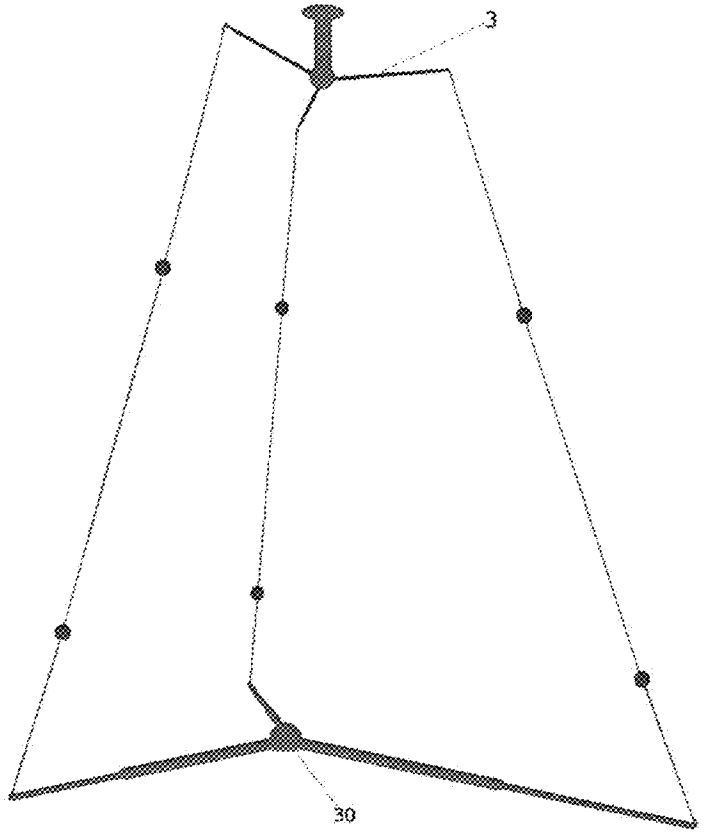
FIG. 19 shows the variant, wherein the floor element is provided with an element, whereby the arms of the floor element can be adjusted from in the terms of their angles in the horizontal plane.

In FIG. 19, the floor element is provided with an element (30), whereby the arms of the floor element can be adjusted in terms of their angles in the horizontal plane. Thus, the users are able to adjust the distance of the individual response targets from themselves and from one another.

Figure 20:
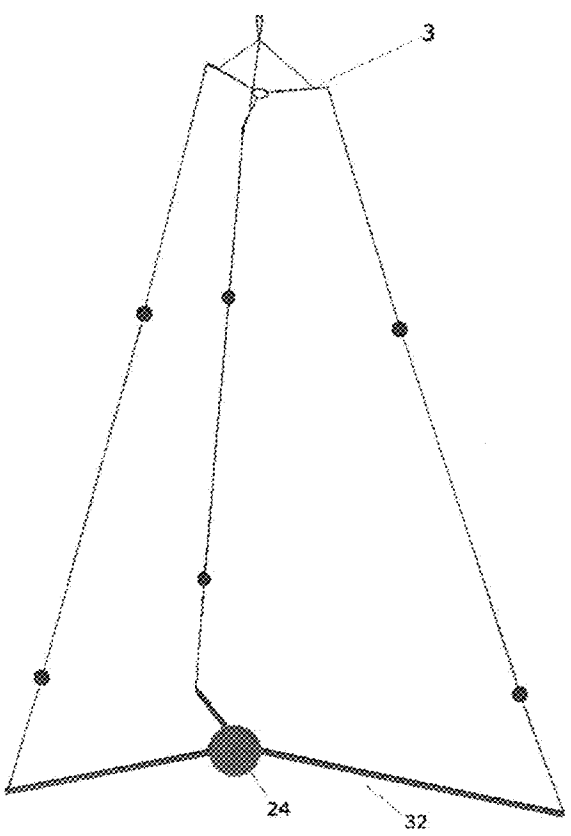
FIG. 20 shows a variant, where the floor element is provided with a sphere positioned on the floor), the floor element is mobile.

FIG. 20 shows a variant, where the floor element is provided with a sphere (24) positioned on the floor), whereby the floor element is mobile and enables momentum propagation.

Figure 21:
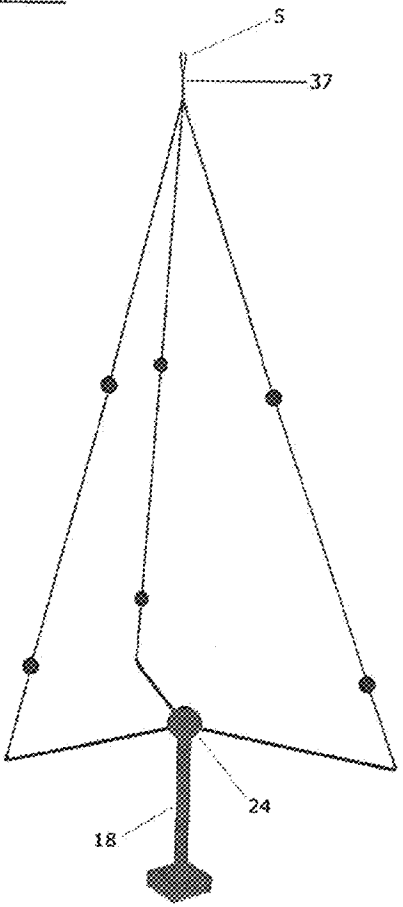
FIG. 21 shows a variant, where the support element comprises the holder cords in the upper extremities further connected together to a carried body.

FIG. 21 shows a variant, where the support element (37) comprises the holder cords (6) in the upper extremities further connected together to a carried body, which enables momentum propagation. Another embodiment of this variant is possible, where the carrier body comprises no holder cords in the upper extremities, but forms a separate unit whereto the holder cords are attached. The advantage of this variant consists in the fact that several training units of this type can be connected together so that several persons are able to train. The individual units can be attached to the upper support element by the hook (5).

Figure 22:
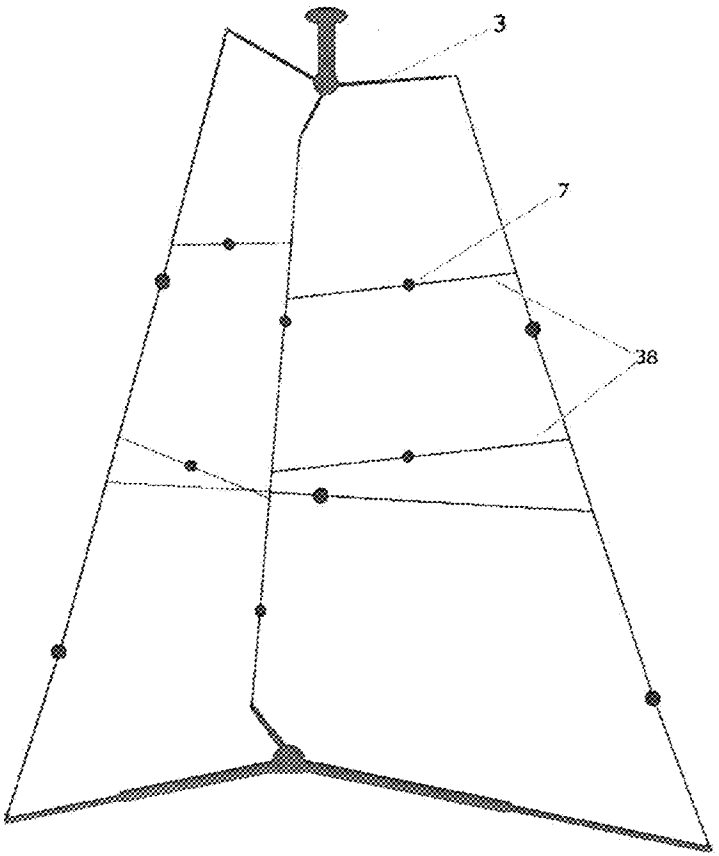
FIG. 22 shows a variant, where holder cords are connected together by means of a holder cord or several holder cords.

FIG. 22 shows a variant, where individual holder cords are connected together (elastically or non-elastically) by means of a holder cord or several holder cords (38). The connecting holder cords (38) can be provided or not with response targets. This variant has the advantage that momentum occurs contributing to the momentum of the support element(s) or no momentum contribution occurs. Moreover, the scope of training can be extended to the response targets attached to the connecting holder cords (38).

Figure 23:
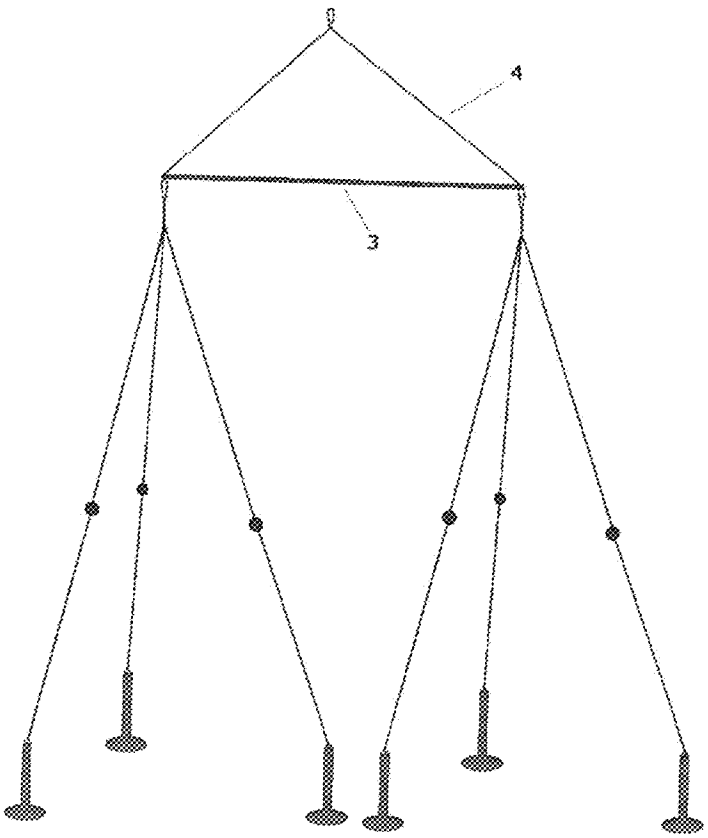
FIG. 23 shows an example, where one or more training device are interconnected with momentum coupling via a support element.

Finally, FIG. 23 shows an example, where one or more training devices are interconnected with momentum coupling via a support element (3), so that several persons can train together, which leads to a stronger momentum propagation and thus to a higher degree of irregularity of the response targets. A connection of this kind or a similar connection of several training devices is possible, in principle, in all embodiments presented.

REFERENCE LIST

1. Individual element
2. Intermediate element
3. Support element
4. Suspension element
5. Hook
6. Elastic cord or rubber cable or rubber band
7. Response target
8. Counterweight
9. Floor weight
10. Cord stopper
11. Suspension points
16. Crank
17. Lower support element
18. Pedestal
19. Lower support element with extendible telescopic arms
20. Extendible pedestal
21. Flexible pedestal
22. Lower support element with flexible arms
24. Mobile spherical element
25. Pedestal with spherical (oval or round etc.) lower end
26. Support element with extendible telescopic arms
30. Element for the adjustment of the arms of the floor element
32. Floor element
37. Support element/carrier body, consisting of the upper extremities of the holder cord, which are connected together with the carrier body.

The invention claimed is:

1. A training device, comprising:
at least two response targets (7);
at least two elastic holder cords (6), each respectively holding at least one of said at least two response targets, wherein each of said at least two elastic holder cords (6) is located, in a taut state, between at least one attachment point above a training area and a floor attachment,
wherein said at least two holder cords (6) are placed at a distance from one another and are connected in a momentum propagation arrangement wherein momentum impacted on one of said response targets, is propagated, at least partially to other holder cords of said at least two elastic holder cords via a support element.

2. The training device of claim 1, wherein said at least two elastic holder cords (6) are stretched between said support element (3) and at least one of: a respective floor attachment, a ceiling attachment or at least one additional support element.

3. The training device of claim 2, wherein mobile or rigid intermediate elements (2) are placed between the support element (3) and each of said at least two elastic holder cords (6), each thereof operationally coupled with at least one holder cord (6).

4. The training device of claim 3, wherein the intermediate elements (2) on the support elements (3) are U-shaped.

5. The training device of claim 4, wherein said at least two elastic holder cords (6) are placed on both extremities of the U-shaped intermediate elements (2).

6. The training device of claim 3, wherein said at least two elastic holder cords (6) are operationally coupled to the intermediate elements via elastic cords placed between the intermediate elements (2).

7. The training device of claim 2, wherein an additional holder cord (6) is stretched between the attachment point of the support element (3) and the floor attachment.

8. The training device of claim 2, wherein the support element (32) is positioned on the floor by means of at least one support surface or support point, which results in the mobility of the support element (32) and thus in momentum propagation over said at least two elastic holder cords (6).

9. The training device of claim 8, wherein the support surface or support point of the support element (3) has a spherical or hemispherical form.

10. The training device of claim 2, wherein the support element (3) or the support elements (3) are placed on an upper part, a lower part or said upper and lower parts of the training device and are combinable with one another.

11. The training device of claim 2, wherein the support element (3) is directly coupled to a ceiling or the floor.

12. The training device of claim 1, wherein the support element (3) comprises at least one rigid, elastic or flexible suspension element (4) for attaching the support element (3) on at least one upper attachment point,
wherein mobility of the support element (3) is adjustable on or through the suspension element (4), and
wherein said at least two holder cords (6) attached to the support element (3) are coupled at attachment points placed at a distance from one another, on the support element (3).

13. The training device of claim 1, wherein said floor attachment includes at least one freely movable floor weight (9).

14. The training device of claim 1, further comprising weight bodies arranged on said at least two elastic holder cords (6), such that said weight bodies form counterweights (8) to the response targets (7), thereby enabling adjustment of the momentum propagation arrangement of the response targets.

15. The training device of claim 14, wherein the response targets (7) and the counterweights (8) are coupled in an adjustable manner on said at least two elastic holder cords (6).

16. The training device of claim 1, further comprising adjustable cord stoppers (10) positioned at least below the response targets (7), such that the response targets (7) are coupled to said at least two elastic holder cords (6) in a detachable and adjustable manner by means of said adjustable cord stoppers (10).

17. The training device of claim 1, wherein constructive elements of the training device are connected in a detachable manner by hook-like components, said constructive elements including: at least one said response target, at least one of said at least two elastic holder cords and elements forming said momentum propagation arrangement.

18. The training device of claim 17, wherein spherical joints (24) are placed within one of said constructive elements or between several said constructive elements of the training device causing or enhancing momentum propagation.

19. The training device of claim 1, wherein the support element (3) includes at least one arm, wherein said at least two elastic holder cords (6) are attached to the support element (3) at least at an upper edge of said at least two elastic holder cords or distributed over the support element (3).

20. The training device of claim 1, wherein the support element is formed by upper extremities of said at least two elastic holder cords connected together with a carrier body.

21. The training device of claim 1, wherein said at least two elastic holder cords (6), which are distanced from one another, run vertically, with response targets (7) placed thereon, and are connected in said momentum propagation arrangement over at least one other horizontally running holder band (38), which connects said at least two elastic holder cords (6) with or without response targets (7) placed thereon.

* * * * *